US010052263B2

(12) United States Patent
Bawa

(10) Patent No.: US 10,052,263 B2
(45) Date of Patent: Aug. 21, 2018

(54) CLEANING PACIFIER AND METHOD OF USE

(71) Applicant: Anoop S. Bawa, Gainesville, VA (US)

(72) Inventor: Anoop S. Bawa, Gainesville, VA (US)

( * ) Notice: Subject to any disclaimer, the term of this patent is extended or adjusted under 35 U.S.C. 154(b) by 0 days.

(21) Appl. No.: 14/662,510

(22) Filed: Mar. 19, 2015

(65) Prior Publication Data

US 2017/0151131 A1 Jun. 1, 2017

(51) Int. Cl.

| | |
|---|---|
| ***A61J 17/00*** | (2006.01) |
| ***A46B 5/04*** | (2006.01) |
| ***A46B 15/00*** | (2006.01) |
| ***A46D 1/00*** | (2006.01) |

(52) U.S. Cl.

CPC ..... *A61J 17/001* (2015.05); *A46B 5/04* (2013.01); *A46B 15/0055* (2013.01); *A46D 1/0207* (2013.01); *A46B 2200/1066* (2013.01)

(58) Field of Classification Search

CPC ..... A61J 17/007; A61J 17/006; A61J 17/001; A61J 17/02; A61B 5/02; A61B 2200/1066

See application file for complete search history.

(56) References Cited

U.S. PATENT DOCUMENTS 5,291,878 A 3/1994 Lombardo et al.
5,385,573 A * 1/1995 Wright ..... A61J 17/007 446/28
5,571,140 A 11/1996 Gura-Emerling
5,615,443 A 4/1997 Lai
5,711,759 A * 1/1998 Smith ..... A61J 17/006 601/139
5,729,859 A 3/1998 Guffin, III
6,134,737 A 10/2000 Remme
6,241,110 B1 * 6/2001 Hakim ..... A61J 11/0055 215/11.1
6,325,817 B1 12/2001 Shen
D453,879 S 2/2002 Carr
6,643,884 B1 * 11/2003 Everett ..... A46B 5/02 15/110

(Continued)

FOREIGN PATENT DOCUMENTS

GB 2067069 A 7/1981
GB 2480453 A 5/2010

*Primary Examiner* — Julie A Szpira
(74) *Attorney, Agent, or Firm* — Johnathan Brown

(57) ABSTRACT

A pacifying cleaning device is comprised, generally, of an elongated and rounded nipple portion attached to a guard portion, a set of bristles protruding from a raised lip displacer located atop the guard portion and located about the base of the nipple portion, and facing generally in the direction of the nipple portion, and a ring attached to the guard portion on the other side. The nipple portion of the pacifying device is inserted by a caregiver into an infant's mouth. The infant sucks on the nipple thereby becoming pacified. As the infant sucks on the nipple, the lip displacer acts to subtly separate an infant's lips so that the bristles attached to the lip displacer can work their way forward into the infant's mouth, between and adjacent to the infant's teeth and/or against the gums. The action of the bristles moving against the teeth and gums serve to clean them, removing contaminants and leaving the infant's teeth much cleaner and free of bacteria than they otherwise would be.

15 Claims, 3 Drawing Sheets

(56) References Cited

U.S. PATENT DOCUMENTS

| | | | | |
|---|---|---|---|---|
| 6,767,357 | B2 * | 7/2004 | Uehara | A61J 17/001 606/235 |
| D624,191 | S | 9/2010 | Johnson | |
| 8,211,144 | B2 * | 7/2012 | Rohrig | A61J 17/001 606/235 |
| 8,214,962 | B2 | 7/2012 | Rohrig | |
| D767,152 | S * | 9/2016 | Hakim | D24/194 |
| 2003/0236556 | A1 * | 12/2003 | Dickerson | A61J 17/02 606/235 |
| 2007/0208380 | A1 | 9/2007 | Ebner | |
| 2009/0248073 | A1 * | 10/2009 | Kliegman | A61J 17/02 606/235 |
| 2013/0072977 | A1 * | 3/2013 | Van Engen | A61J 17/02 606/235 |
| 2013/0220357 | A1 | 8/2013 | Campbell | |
| 2013/0304121 | A1 * | 11/2013 | Hakim | A61J 17/02 606/235 |

* cited by examiner

CLEANING PACIFIER AND METHOD OF USE

TECHNICAL FIELD OF THE INVENTION

The present invention relates to the general art of oral hygiene.

BACKGROUND OF THE INVENTION

It is important to keep the teeth of infants and young children cleaned, and free of infection, yet this has recently become more challenging. One continuing problem is an infection known by several names, including "Baby Bottle Caries." Baby bottle caries, early childhood caries and bottle rot. It is a disease derived from a bacterial infection that results in decay in the teeth of infants and younger children. Baby bottle caries has greatly increased in the US to an epidemic level. In some populations and areas of the country, particularly in rural and minority populations, as many as 70% of children are infected.

In addition to infections, cavities, because of the greater availability of foods containing processed sugars, are much more prevalent. Cavities, if left untreated, can lead to infection and rot, and possible loss, of individual teeth and even parts of the gums underlying them.

The incidence of problems such as cavities, baby bottle caries and other dental issues can be greatly reduced by regular teeth cleaning and removal of the bacteria. In addition, it is generally important, for good dental hygiene, that infant teeth be periodically cleaned.

However, obtaining regular cleanings can be difficult. Many do not have the funds, or ability to schedule cleanings for their infant or young child, and often, even regular dental care and visits go neglected until there is an unavoidable problem or great pain. Furthermore, getting infants and young children to keep from moving around while having their teeth cleaned can add a layer of difficulty to the cleanings themselves. Some infants and children can have such a hard time staying still, doe to anxiety or excess energy, that cleaning their teeth without anesthesia can be nearly or completely impossible.

Therefore, there is a need for an orally hygienic product to help infants keep their teeth clean while keeping them calm.

SUMMARY

These and other objects are achieved by an orally hygiene pacifier that calms infants and young children white helping to clean their teeth.

In one embodiment of the invention, a pacifying teeth-cleaning device is shown. Use pacifying cleaning device is comprised, generally, of an elongated and rounded nipple portion attached to a guard portion, a set of bristles protruding from a raised lip displacer located atop the guard portion 16 and located about the base of the nipple portion, and a ring or handle attached to the guard portion on the other side from the nipple. The ring or handle serves primarily as a safety feature to enable a caregiver to quickly remove the pacifying cleaning device.

The nipple portion of the pacifying device is inserted by a caregiver into an infant's month. As the infant sucks on the pacifying device, the infant's mouth is pressed against the Hp displacer. The protuberance of the lip displacer, accompanied by a rounded shape, act to gently push the infant's lips apart. The separation is continues and reinforced by the infant's sucking action on the nipple. As the infant continues sucking on the nipple and the infant's lips become separated by the lip displacer, the bristles atop the lip displacer are able to, partly because of the lip separation acting of the lip displacer, work their way forward past the lips and into the infant's mouth, between and adjacent to the infant's teeth and against the infant's gums.

The action of the bristles moving against the teeth aid gums, brought about by the sucking motions of the infant, serve to clean the teeth and gums, removing contaminants that can help cause infection. Thereby, the infant's teeth are left much cleaner and tree of bacteria than they otherwise would be had they not had contact with the bristles, helping prevent cavities and infections.

DETAILED DESCRIPTION OF PREFERRED EMBODIMENTS

Other objects, features and advantages of the invention will become apparent from a consideration of the following detailed description and the accompanying drawings. The following descriptions are made referring to the figures, wherein like reference number refer to like features throughout this description.

Figure 1:
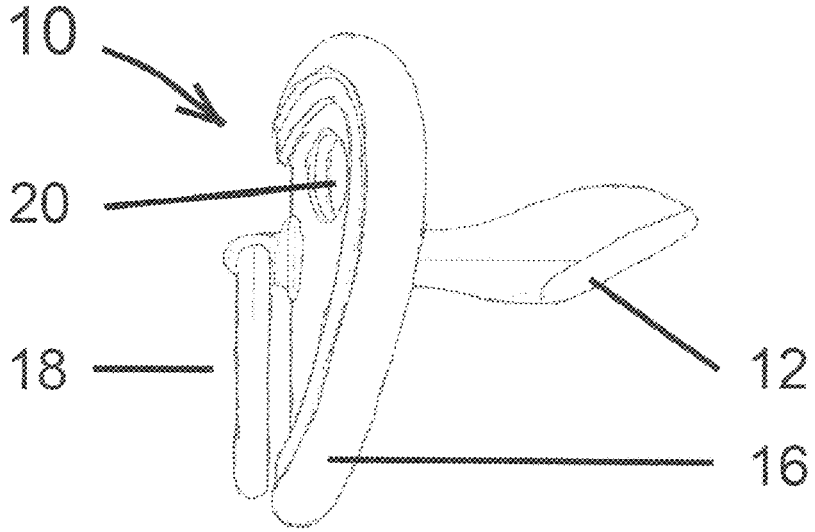
FIG. 1 is a side view of an embodiment of the present invention.
Figure 2:
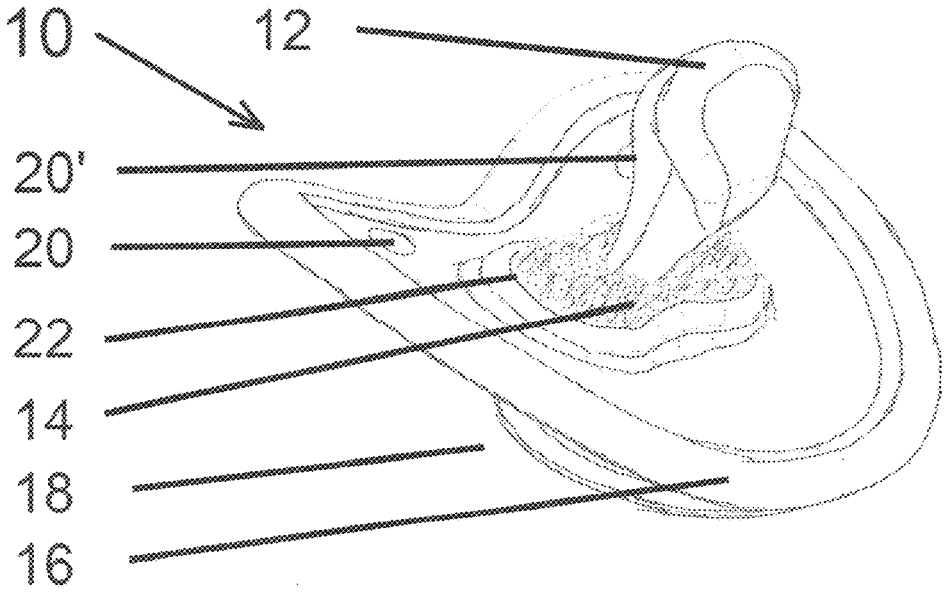
FIG. 2 is a perspective view of the embodiment of shown in FIG. 1.

One exemplary embodiment of the present invention is shown in FIGS. 1-2. Turning to FIG. 1, a pacifying gum and teeth cleaning device 10 ("pacifying device") is shown. The pacifying cleaning device 10 is comprised, generally, of an elongated and rounded nipple portion 12 attached to a guard portion 16, a raised lip displace 22 located atop the guard portion 16 and located about the base of the nipple portion 12, and a set of bristles, represented herein as 14, for clarity, protruding from the lip displacer 22 in the direction of the nipple portion 12 and a ring 18 attached to the guard portion 16 on the other side of the pacifying device 10.

The ring 18 serves primarily as a safety feature to enable a caregiver to quickly remove the pacifying device 10 if necessary. The ring 18 serves primarily as a handle and though if is in the shape of a ring in this embodiment, can be any suitable shape for carrying out its task. Another safety feature of the pacifying device 10 are apertures 20, 20' that are present in the guard 16 so that an infant can continue to breathe in case the pacifying device 10 somehow becomes stuck or lodged. In this embodiment, there are two apertures 20, 20.' One of the apertures, 20, is shown in FIG. 1 and both apertures 20, 20' are shown in FIG. 2.

The nipple portion 12 of the pacifying device 10 is inserted by a caregiver, possibly by the ring 18, into an infant's mouth. As the infant sucks on the pacifying device 10, the infant's month is pressed against the Hp displacer 22. The protuberance of the lip displacer 10, accompanied by a rounded shape, act to gently push the infant's lips apart.

Hereinafter, the term "infant" will be understood to mean infant or a young child. The separation, is continues and reinforced by the infant's sucking action on the nipple 12, which also helps pacify the infant. As the infant continues sucking on the nipple 12 and the infant's lips are become separated by the lip displacer 22, the bristles 14 atop the lip displacer are able to, partly because of the lip separation of the lip displacer 22, work their way forward past the lips and into the infant's mouth, between and adjacent to the infant's teeth said against the infant's gums, or if the infant has no teeth, then simply against the gums. The action of the bristles 14 moving against the teeth, and gums, brought about by the sucking motions of the infant, serve to clean the teeth and gums, removing contaminants that can help cause infection. Thereby, the infant's teeth are left much cleaner and free of bacteria than they otherwise would be had they not had contact with the bristles 14, helping prevent cavities and infections.

The pacifying device 10 can be any size determined useful for carrying out its function. In this embodiment, the pacifying device 10 is about 2.0-3.0 inches long, and more particularly, about 2.0-2.5 inches long; the length understood as extending from the tip of the nipple 12 to the top of the ring 18. The pacifying device 10 in this embodiment has a width of about 2.0-3.0 inches and more particularly, 2.0-2.5 inches; the width understood as meaning the width of the guard portion 16 at its widest point.

The lip displacer 22 can be any size and orientation suitable for its task: providing sufficient displacement of an infant's lips. In this embodiment, the lip displacer 22 can have a width of about 0.75 to about 2.0 inches and more particularly, a width of about 1.0 inches to about 1.5 inches. It can have a length of about 0.3 inches to about 1.25 inches and more particularly, a length of about 0.5 inches to about 1.0 inches. The lip displacer 22 can be raised to any suitable height relative to the surface of the guard portion 16 upon which it rests that is suitable for the lip displacer to perform its function, depending on factors such as the size and age of the child and bristle configuration. In this embodiment, the lip displacer 22, can be about ¼ inch to about ½ inch and more particularly, can be about 3⁄16 of an inch to about ⅜ of an inch.

The lip displacer 22 can be any suitable shape to complete its function. In this embodiment, the lip displacer is in a rounded loosely hourglass or butterfly wing configuration, as this appears to provide good separation of an infant's lips for cleaning. However, the lip displacer 22 can be any suitable shape for completing its task.

Turning to the components of the pacifying device, 10, it is to be understood that the pacifying device 10, and the individual parts of the pacifying device 10, can be comprised of any suitable material in the art, including, but not limited to, latex, any suitable type of plastic such as a hard and/or flexible plastic, other resin, silicone, rubber or rubberized material or any combination of these. The pacifying device 10 can be comprised, other than the bristles, of a single piece construction with the bristles 14, added by means known in the art.

In this embodiment, the pacifying device 10 is a single-piece construction of latex, rubber, silicone or flexible plastic. The pacifying device 10 can, however, be of a multi-piece construction, with the pieces attached by any acceptable and safe means known in the art. For example, the nipple 12, guard 16, ring 18 and lip displacer 22, or any part of these components, can be fused together during manufacture. The pacifying device 10 is of a suitable size for use, as known in the pacifier art.

In this embodiment, the guard 16 is generally heart-shaped and rounded such that the outward horizontal portions of the guard 16 rise in the direction of the nipple 12, to conform with the contours of an infant's mouth, jaw and nose. However, the pacifying device 10 can be any suitable shape that allows it to perform its function of resting against the outside of the infant's mouth and preventing ingestion, such as, e.g., a more rounded shape, a more rectangular shape with rounded corners, or a shape with protrusions, such as a shape resembling a, clover or butterfly.

Figure 3:
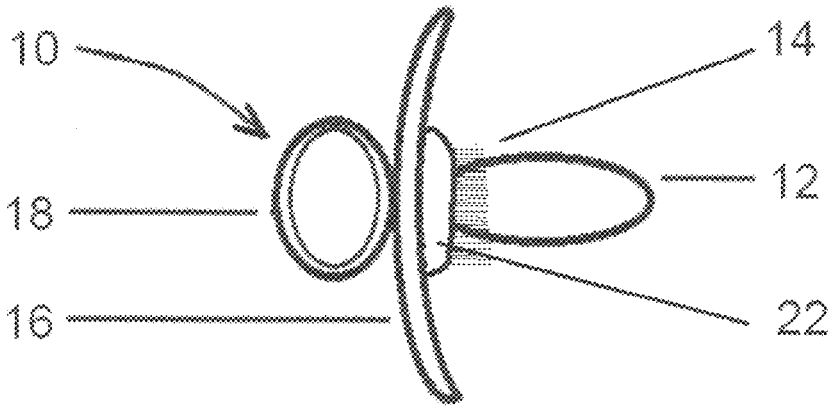
FIG. 3 is a side view of another embodiment of the present invention.
Figure 4:
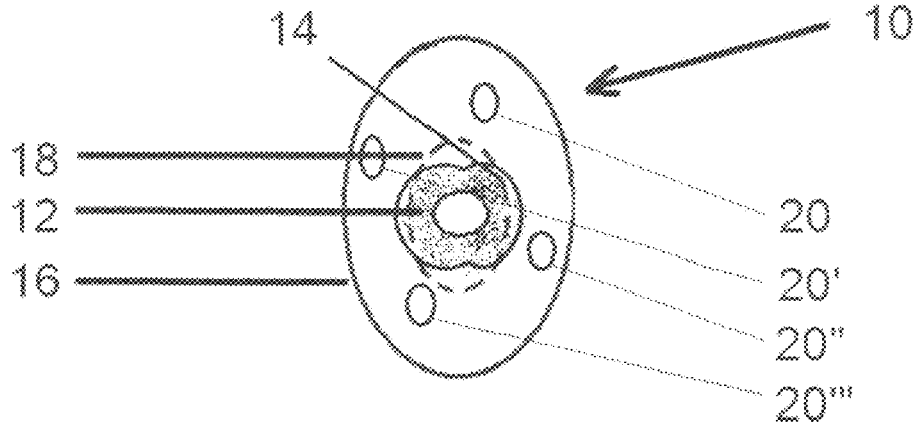
FIG. 4 is a frontal view of the embodiment shown in FIG. 3.

Turning briefly to FIGS. 3-4, a more rounded, and conventional shape for the guard 16 and nipple 12 are shown.

Returning to FIGS. 1-2, the ring 18 is round in these embodiment, hut can be any suitable shape, such as a multi-sided configuration, so long as the ring 18 is suitable for its primary purpose, aiding in quick removal from the infant's mouth if necessary. The nipple 12, is elongated and rounded, with a sloping on the lower side of the nipple 12. It can also be rounded, as is typical in the art and shown at FIGS. 3-6, but can be of any suitable configuration for its purpose: providing an infant with a protuberance to suck upon.

The bristles 14 can be made of any suitable material, and of any suitable configuration known in the art for generating an effective cleaning action for infant teeth and/or gums. In this embodiment, the bristles are comprised of fine, plastic bristles as known in the teeth-cleaning art. The bristles 14 can be comprised of soft or extra soft bristles, as the terms are known and understood in the art, particularly in regard to infant tooth care. The bristles 14 can be further comprised, as in this embodiment, of a nylon, but can also be comprised of any suitable materials in the art, such as another type of resin or plastic.

Figure 5:
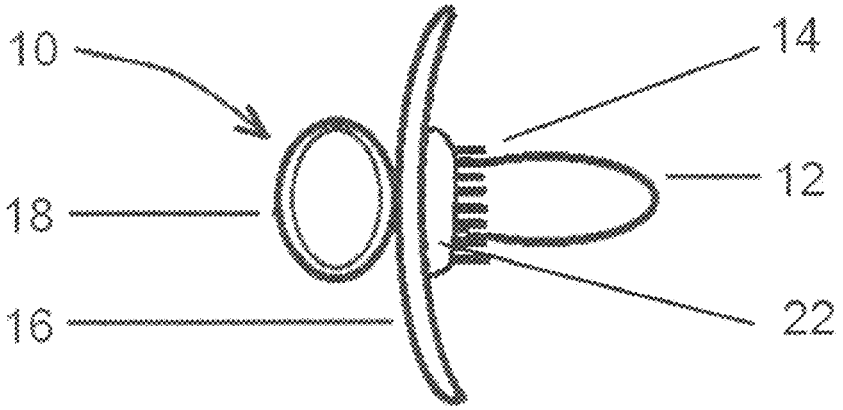
FIG. 5 is a side view of yet another embodiment of the present invention.
Figure 6:
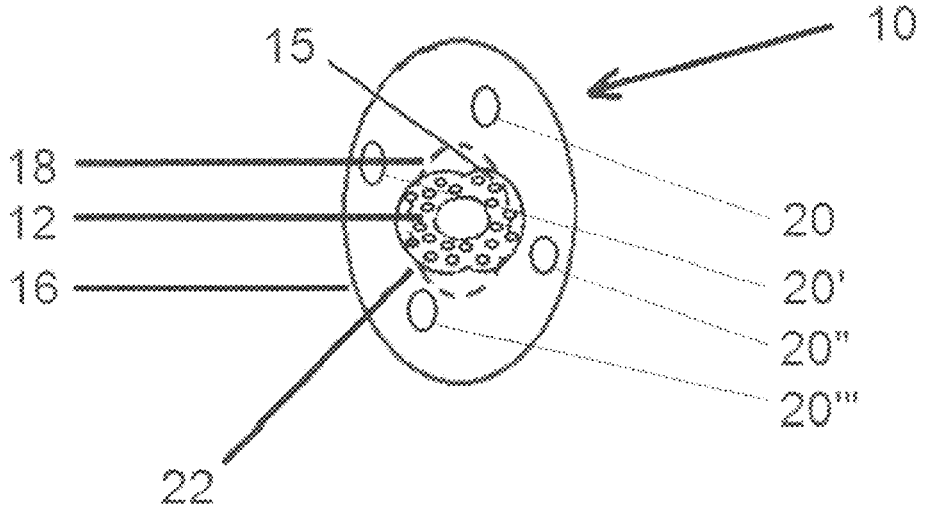
FIG. 6 is a frontal view of the embodiment shown in FIG. 5.

Turning briefly to FIGS. 5-6, in another embodiment instead of bristles, a more limited number of individual soft protuberances, represented as 15, 15', 15" for clarity, are shown. The protuberances 15, 15', 15" are comprised of silicone, plastic or other suitable material known in the art. This can be especially advantageous in the case of infants with limited or no teeth, wherein the concern is the toughening and cleaning of the gums. In another embodiment the protuberances can be comprised of soft triangular nubs suitable for movement between teeth, or nubs of other suitable size, type and configuration. The protuberances or nubs herein in these embodiments 15, 15', 15" are soft or extra soft, as these terms are known and understood within the infant tooth and gum care art. The protuberances or nubs can be comprised of any suitable material or materials, such as latex, rubber, a rubberized material, plastic or resin, silicone, material or any combination of these.

By this simple method and device, an infant's teeth can be more easily and thoroughly cleaned while simultaneously keeping the infant calm and pacified.

It is to be understood that while certain forms of the present invention have been illustrated and described herein, the expression of these individual embodiments is for illustrative purposes and should not be seen as a limitation upon the scope of the invention. It is to be further understood that the invention is not to be limited to the specific forms or arrangements of parts described and shown.

COMPONENT LIST

10 PACIFYING DEVICE
12 HIPPIE
14 BRISTLES
15 PROTUBERANCES

16 GUARD
18 HANDLE
20 APERTURES
22 LIP DISPLACER

The invention claimed is:

1. A gum and teeth cleaning device comprised of a nipple portion, a guard portion, a lip displacer, a set of bristles, and a handle, wherein the nipple portion and handle are each attached to the guard portion, to each other, or both, and wherein the lip displacer is located atop the guard portion, and wherein the lip displacer is raised relative to the guard portion in an orientation generally parallel to the longitudinal axis of the nipple portion, and wherein the lip displacer surrounds or partially surrounds the base of the nipple portion, and wherein the handle is attached to the guard portion and is located on the opposite side of the guard portion relative to the nipple portion and lip displacer, and wherein the bristles are located atop the lip displacer and extend from the lip displacer, with an orientation generally parallel to the longitudinal axis of the nipple portion, and wherein the bristles are soft or extra soft bristles.

2. The gum and teeth cleaning device of claim 1, wherein the nipple portion is elongated and rounded at the distal end from the guard portion.

3. The gum and teeth cleaning device of claim 1, wherein the handle is in the form of a ring.

4. The gum and teeth cleaning device of claim 1, wherein the teeth cleaning device is about 2.0-3.0 inches long and is about 2.0-3.0 inches wide.

5. The gum and teeth cleaning device of claim 1, wherein the teeth cleaning device is about 2.0-2.5 inches long, and is about 2.0-2.5 inches wide.

6. The gum and teeth cleaning device of claim 1, wherein the lip displacer is about 0.75 to about 2.0 inches wide.

7. The gum and teeth cleaning device of claim 1, wherein the lip displacer is about 0.3 inches to about 1.25 inches long.

8. The gum and teeth cleaning device of claim 1, wherein the lip displacer is about ¼ inch to about ½ inch high relative to the surface of the guard portion.

9. The gum and teeth cleaning device of claim 1, wherein the lip displacer is rounded in an hourglass or butterfly wing configuration.

10. The gum and teeth cleaning device of claim 1, wherein the pacifying device, or at least one individual components of the pacifying device, is comprised of latex, a plastic or other resin, silicone, rubber or rubberized material or any combination thereof.

11. The gum and teeth cleaning device of claim 1, wherein the pacifying device, other than the set of bristles, is of a single-piece construction and is comprised of a plastic or other resin, silicone, rubber or rubberized material or any combination thereof.

12. The gum and teeth cleaning device of claim 1, wherein the guard portion is of a generally heart shape, rounded shape, a generally rectangular shape with rounded corners, or a generally clover or butterfly shape.

13. The gum and teeth cleaning device of claim 1, wherein the handle is round.

14. The gum and teeth cleaning device of claim 1, wherein the nipple is elongated and rounded with a sloping on one side of the nipple.

15. The gum and teeth cleaning device of claim 1, wherein the bristles are comprised of a silicone, latex, rubber, a rubberized material, plastic or resin, or any combination thereof.

* * * * *